US006507957B1

(12) United States Patent
Ingram

(10) Patent No.: US 6,507,957 B1
(45) Date of Patent: Jan. 21, 2003

(54) PORTABLE CONTAINER DEVICE

(76) Inventor: Michael P. Ingram, 3610 Pinecrest Dr., Zanesville, OH (US) 43701

( * ) Notice: Subject to any disclaimer, the term of this patent is extended or adjusted under 35 U.S.C. 154(b) by 0 days.

(21) Appl. No.: 10/051,029

(22) Filed: Jan. 18, 2002

(51) Int. Cl.[7] ..... A61J 19/00
(52) U.S. Cl. ..... 4/259; 4/282
(58) Field of Search ..... 4/259, 267, 271, 4/258, 274, 282, 285, 283; 220/351, 345.1, 348, 349, 350, 345.4

(56) References Cited

U.S. PATENT DOCUMENTS 1,012,471 A * 12/1911 Steinke ..... 4/259
1,090,264 A * 3/1914 Adams
2,159,978 A * 5/1939 Parkin
2,378,774 A * 6/1945 Husted
2,757,859 A * 8/1956 Holland ..... 4/259
3,938,690 A * 2/1976 Butler
3,949,916 A * 4/1976 Yount
4,303,178 A * 12/1981 Ford, Jr. ..... 4/271
4,503,572 A 3/1985 Dawson
4,628,547 A 12/1986 Baker
4,885,809 A 12/1989 Muchmore
5,396,664 A 3/1995 King
D398,119 S 9/1998 Corbin et al.
5,832,543 A 11/1998 Bosserman
5,924,425 A * 7/1999 Luedecke ..... 131/231

* cited by examiner

*Primary Examiner*—Charles R. Eloshway

(57) ABSTRACT

A portable container device for providing a user with a portable receptacle for spitting tobacco juice. The portable container device includes a housing that has a bottom wall, a top wall, and a peripheral wall that extends between the top and bottom walls. A slot extends through the top wall and opens into an interior of the housing. A door is selectively positionable between an open position opening the second portion and a closed position.

1 Claim, 4 Drawing Sheets

PORTABLE CONTAINER DEVICE

BACKGROUND OF THE INVENTION

1. Field of the Invention

The present invention relates to portable container devices and more particularly pertains to a new portable container device for providing a user with a portable receptacle for spitting tobacco juice.

2. Description of the Prior Art

The use of portable container devices is known in the prior art. U.S. Pat. No. 4,885,809 describes a portable pocket spittoon with a handgrip and hinged lid. Another type of portable container device is U.S. Pat. No. 5,396,664 having spittle container and a removable funnel section and a cap.

While these devices fulfill their respective, particular objectives and requirements, the need remains for a device including a lid assembly that requires the use of only one of the user's fingers to open and close the lid assembly.

SUMMARY OF THE INVENTION

The present invention meets the needs presented above by providing a new portable container device that would be easy to hold and open and close with one hand, making it ideal for use while driving.

Even still another object of the present invention is to provide a new portable container device that provide a means to keep the juice out of sight and the odor of the juice inside the present invention.

To this end, the present invention generally comprises a housing that has a bottom wall, a top wall, and a peripheral wall that extends between the top and bottom walls. A slot extends through the top wall and opens into an interior of the housing. A door is selectively positionable between an open position opening the second portion and a closed position.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
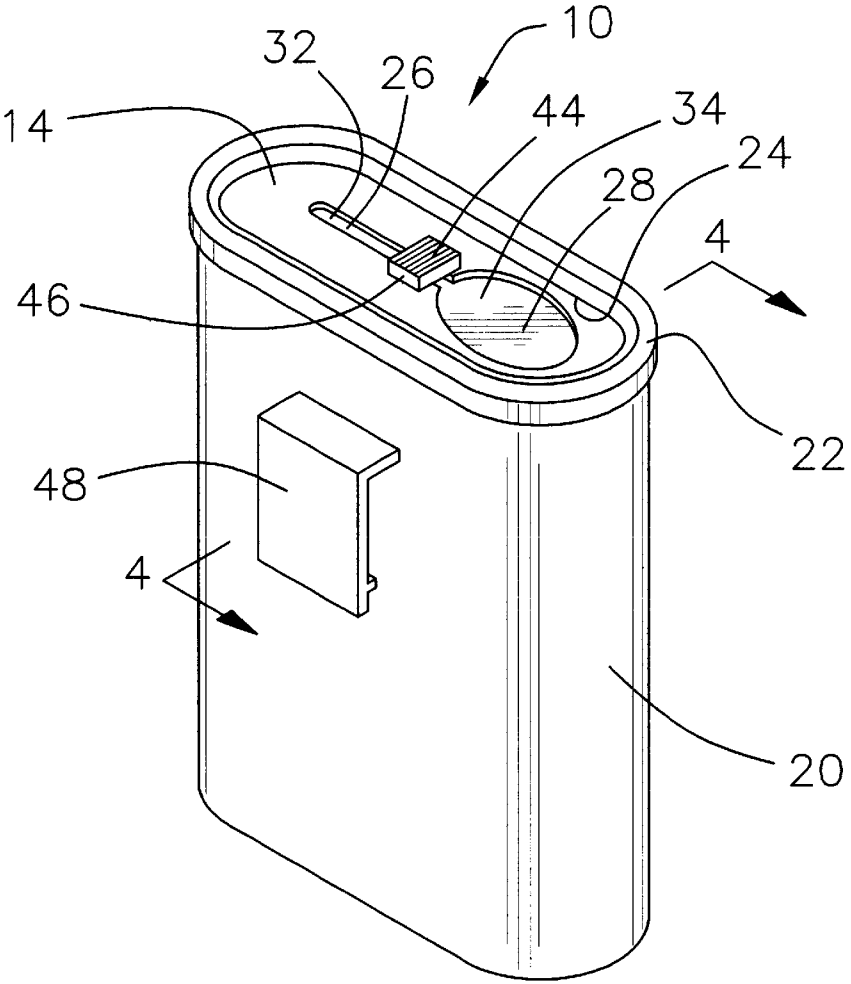
FIG. 1 is a perspective view of a new portable container device according to the present invention.
Figure 2:
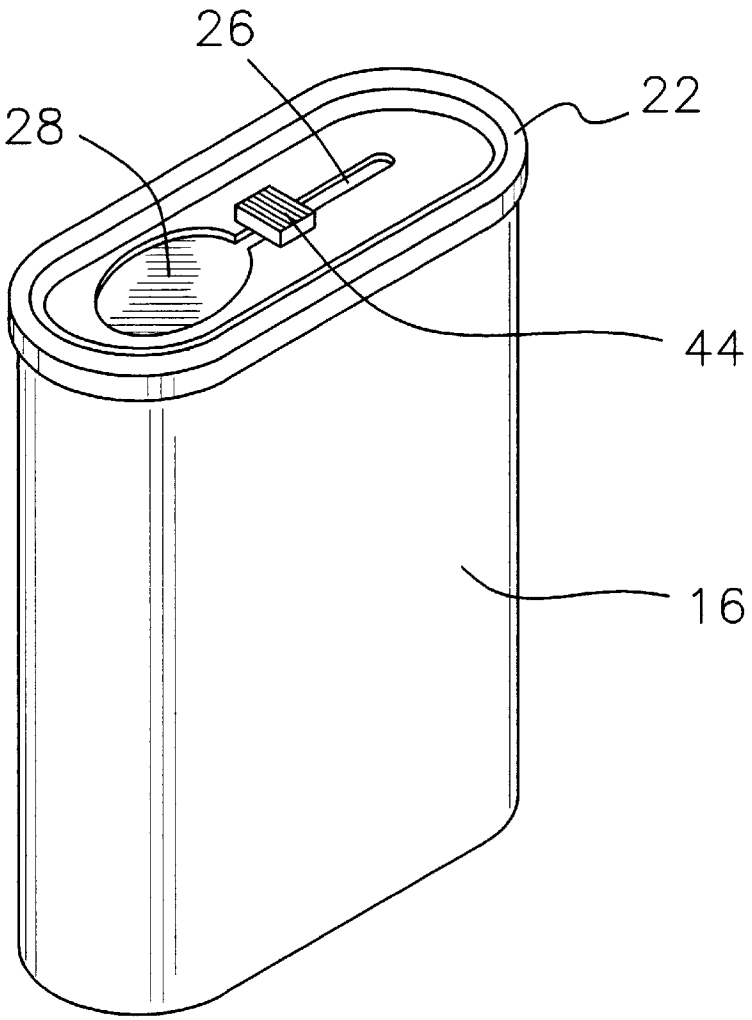
FIG. 2 is a perspective view of the present invention.
Figure 3:
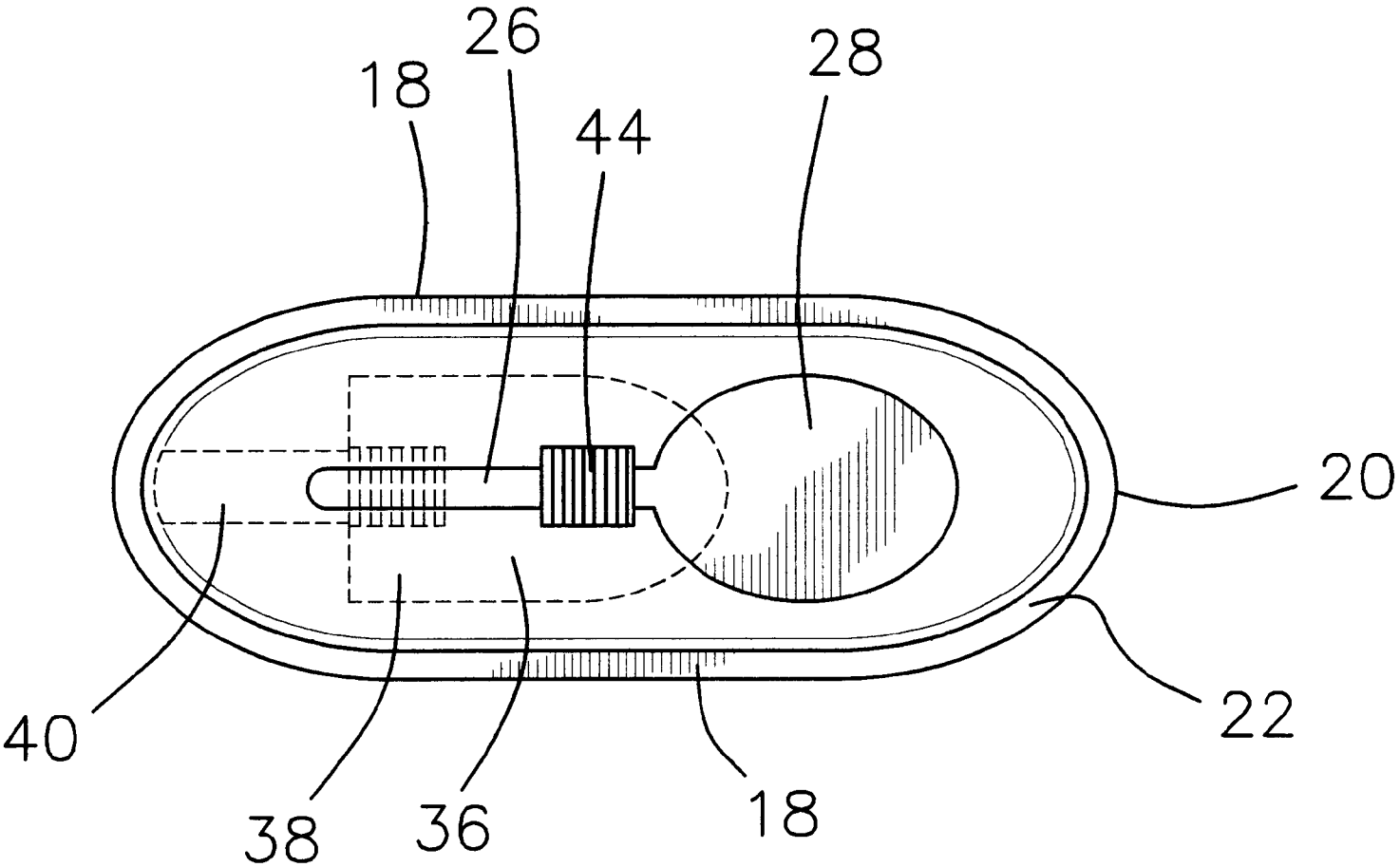
FIG. 3 is a top view of the present invention.
Figure 4:
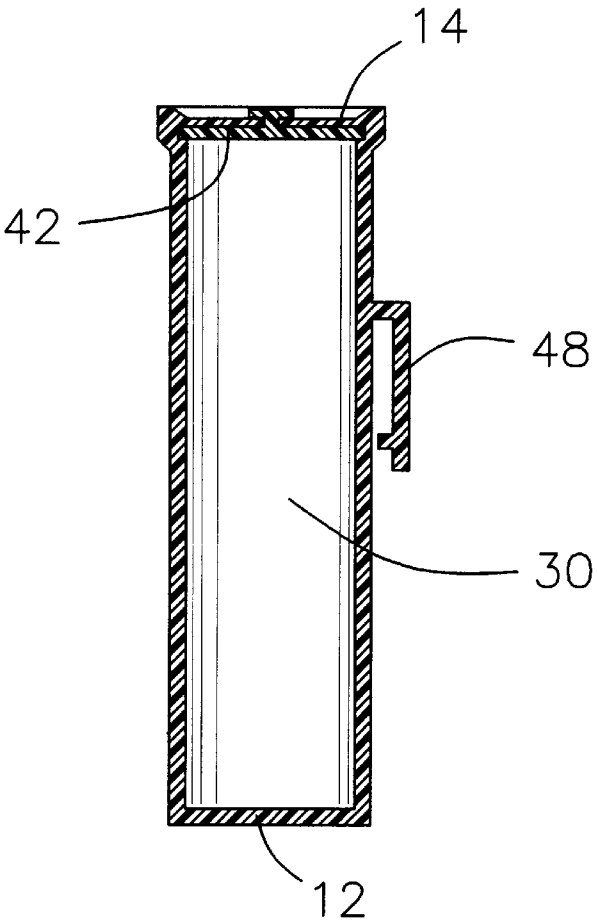
FIG. 4 is a cross-sectional view of the present invention.

With reference now to the drawings, and in particular to FIGS. 1 through 4 thereof, a new portable container device embodying the principles and concepts of the present invention and generally designated by the reference numeral 10 will be described.

As best illustrated in FIGS. 1 through 4, the portable container device 10 generally comprises a housing that has a bottom wall 12, a top wall 14, and a peripheral wall 16 that extends between the top 14 and bottom 12 walls. The peripheral wall 16 includes a pair of side walls 18 and a pair of end walls 20. The end walls 20 is arcuate. A peripheral lip 22 is attached to and extends around an edge 24 of the top wall 14. A slot 26 extends through the top wall 14 and the opening 28 into an interior 30 of the housing. The slot 26 generally includes a first portion 32 and a second portion 34. The first portion 32 is elongated, the second portion 34 generally has an oval shape.

A door 36 is selectively positionable between an open position opening the second portion 34 and a closed position. The door 36 includes a panel 38 that has a shape for covering the second portion 34 of the opening 28. A rod 40 is attached to and extends away from the panel 38 such that the rod 40 is covering the first portion 32 when the second portion 34 is covered by the panel 38. The panel 38 and the rod 40 is positioned adjacent to the inner surface 42 of the top wall 14. A grip 44 is attached to the panel 38. The grip 44 extends through the first portion 32 of the slot 26 and has an exposed portion 46 that extends about an outer surface of the top wall 14 and has a width greater than a width of the first portion 32. A belt clip 48 is attached to the peripheral wall 16. The belt clip 48 is located on one of the side walls 18 of the housing.

In use, a user would hold the present invention in their hand and slide the door open with a finger or thumb, to open and close the spit hole. When the door was closed, the present invention could not spill its contents.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A container device for receiving and containing expelled saliva, said device comprising:

a housing having a bottom wall, a top wall, and a peripheral wall extending between said top and bottom walls, said peripheral wall including a pair of side walls and a pair of end walls, said end walls being arcuate, a peripheral lip being attached to and extending around an edge of said top wall;

a slot extending through said top wall and opening into an interior of said housing, said slot generally including a first portion and a second portion, said first portion being elongated, said second portion generally having an oval shape;

a door being selectively positionable between an open position opening said second portion and a closed position, said door including;

a panel having a shape for covering said second portion of said door;

a rod being attached to and extending away from said panel such that said rod covers said first portion when said door is in said closed position and said second portion is covered by said panel and such that a free end of said rod abuts against a portion of said perimeter wall when said door is in said open position for limiting movement of the door, said panel and rod being positioned adjacent to said inner surface of said top wall;

a grip being attached to said panel, said grip extending through said first portion of said slot and having an exposed portion extending about an outer surface of said top wall having a width greater than a width of said first portion; and a belt clip being attached to said peripheral wall, said belt clip being located on one of said side walls of said housing.

* * * * *